US009759397B2

(12) United States Patent
Kadowaki

(10) Patent No.: US 9,759,397 B2
(45) Date of Patent: Sep. 12, 2017

(54) VEHICULAR LAMP

(71) Applicant: KOITO MANUFACTURING CO., LTD., Minato-ku, Tokyo (JP)

(72) Inventor: Takahiro Kadowaki, Shizuoka-shi (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 14/478,173

(22) Filed: Sep. 5, 2014

(65) Prior Publication Data

US 2015/0070923 A1 Mar. 12, 2015

(30) Foreign Application Priority Data

Sep. 10, 2013 (JP) ..... 2013-187577

(51) Int. Cl.

*F21S 8/10* (2006.01)
*F21Y 101/00* (2016.01)
*F21Y 115/10* (2016.01)

(52) U.S. Cl.

CPC ..... *F21S 48/1104* (2013.01); *F21S 48/1159* (2013.01); *F21S 48/1305* (2013.01); *F21S 48/1747* (2013.01); *F21Y 2101/00* (2013.01); *F21Y 2115/10* (2016.08)

(58) Field of Classification Search

CPC . F21S 48/1305; F21S 48/1747; F21S 48/1104
See application file for complete search history.

(56) References Cited

U.S. PATENT DOCUMENTS

2010/0290241 A1* 11/2010 Tsukamoto ..... 362/519
2011/0170307 A1 7/2011 Ishikawa

FOREIGN PATENT DOCUMENTS

CN 1140817 A 1/1997
CN 2604607 Y 2/2004
CN 101886781 A 11/2010
CN 201719520 U 1/2011

(Continued)

OTHER PUBLICATIONS

Communication dated May 5, 2016, from the State Intellectual Property Office of People's Republic of China in counterpart application No. 201410455043.9.

(Continued)

*Primary Examiner* — Donald Raleigh
*Assistant Examiner* — Jacob R Stern
(74) *Attorney, Agent, or Firm* — Sughrue Mion, PLLC

(57) ABSTRACT

A vehicular lamp includes: a circuit board having three or more light source mounting portions provided along a vehicle-width direction; a plurality of light sources mounted on the respective light source mounting portions; and a reflector unit having three or more reflectors each reflecting light from each of the light sources. The reflector unit has a first positioning pin and a second positioning pin. The circuit board has a first positioning hole to receive the first positioning pin and a second positioning hole to receive the second positioning pin. The first positioning hole is provided at a location inward of a first end light source mounting portion positioned on one end side in the vehicle-width direction, and the second positioning hole is provided at a position inward of a second end light source mounting portion positioned on the other end side in the vehicle-width direction.

4 Claims, 6 Drawing Sheets

(56) References Cited

FOREIGN PATENT DOCUMENTS

| | | | |
|---|---|---|---|
| CN | 102147090 | A | 8/2011 |
| DE | 102010043313 | A1 | 5/2012 |
| JP | 2011-081975 | A | 4/2011 |

OTHER PUBLICATIONS

Chinese Office Action corresponding to Chinese Patent Application No. 201410455043.9, dated Jan. 3, 2017.
Zhang Ailan, et al., Engineering Design and Construction of Large Building Steel Structure in China, p. 552, published May 31, 2007.
Shen Ding, et al., Guidelines for Home Decoration, Zhejiang Photography Press, p. 29, published Aug. 31, 2008.

* cited by examiner

VEHICULAR LAMP

INCORPORATION BY REFERENCE

The disclosure of Japanese Patent Application No. 2013-187557 filed on Sep. 10, 2013 including the specification, drawings and abstract is incorporated herein by reference in its entirety.

BACKGROUND OF THE INVENTION

1. Field of the Invention

The invention relates to a vehicular lamp.

2. Description of Related Art

Conventionally, vehicular lamps having a plurality of light-emitting diodes (LEDs) and a plurality of reflectors each reflecting light from each of the LEDs have been available (see, for example, Japanese Patent Application Publication No. 2011-81975 (JP2011-81975 A)).

However, it is likely that the vehicular lamps having the plurality of LEDs and the plurality of reflectors are upsized.

SUMMARY OF THE INVENTION

The invention provides a vehicular lamp that is small in size although it has a plurality of light sources and reflectors.

An aspect of the invention relates to a vehicular lamp including: a circuit board having three or more light source mounting portions provided along a vehicle-width direction; a plurality of light sources mounted on the respective light source mounting portions; and a reflector unit having three or more reflectors each reflecting light from each of the light sources. The reflector unit has a first positioning pin and a second positioning pin. The circuit board has a first positioning hole to receive the first positioning pin and a second positioning hole to receive the second positioning pin. The first positioning hole is provided at a location inward of a first end light source mounting portion positioned on one end side of the circuit board in the vehicle-width direction, among the light source mounting portions, and the second positioning hole is provided at a position inward of a second end light source mounting portion positioned on the other end side of the circuit board in the vehicle-width direction, among the light source mounting portion.

The first positioning hole may be provided between the first end light source mounting portion and one of the light source mounting portions adjacent to the first end light source mounting portion, and the second positioning hole may be provided between the second end light source mounting portion and one of the light source mounting portions adjacent to the second light source mounting portion.

The first positioning hole may be f a long hole extending in the vehicle-width direction of the circuit board, and the second positioning hole may be a substantially same shape and size as the second positioning pin.

According to an embodiment of the invention, it is possible to achieve a vehicular lamp that is small in size although it has a plurality of light sources and reflectors.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, a description will be given in detail of a vehicular lamp according to an embodiment of the invention with reference to the drawings. Note that when terms indicating directions such as "top," "bottom," "front," "rear," "left," "right," "inside," and "outside" are used in the specification, they represent directions in a position in which a vehicular lamp is mounted on a vehicle.

Figure 1:
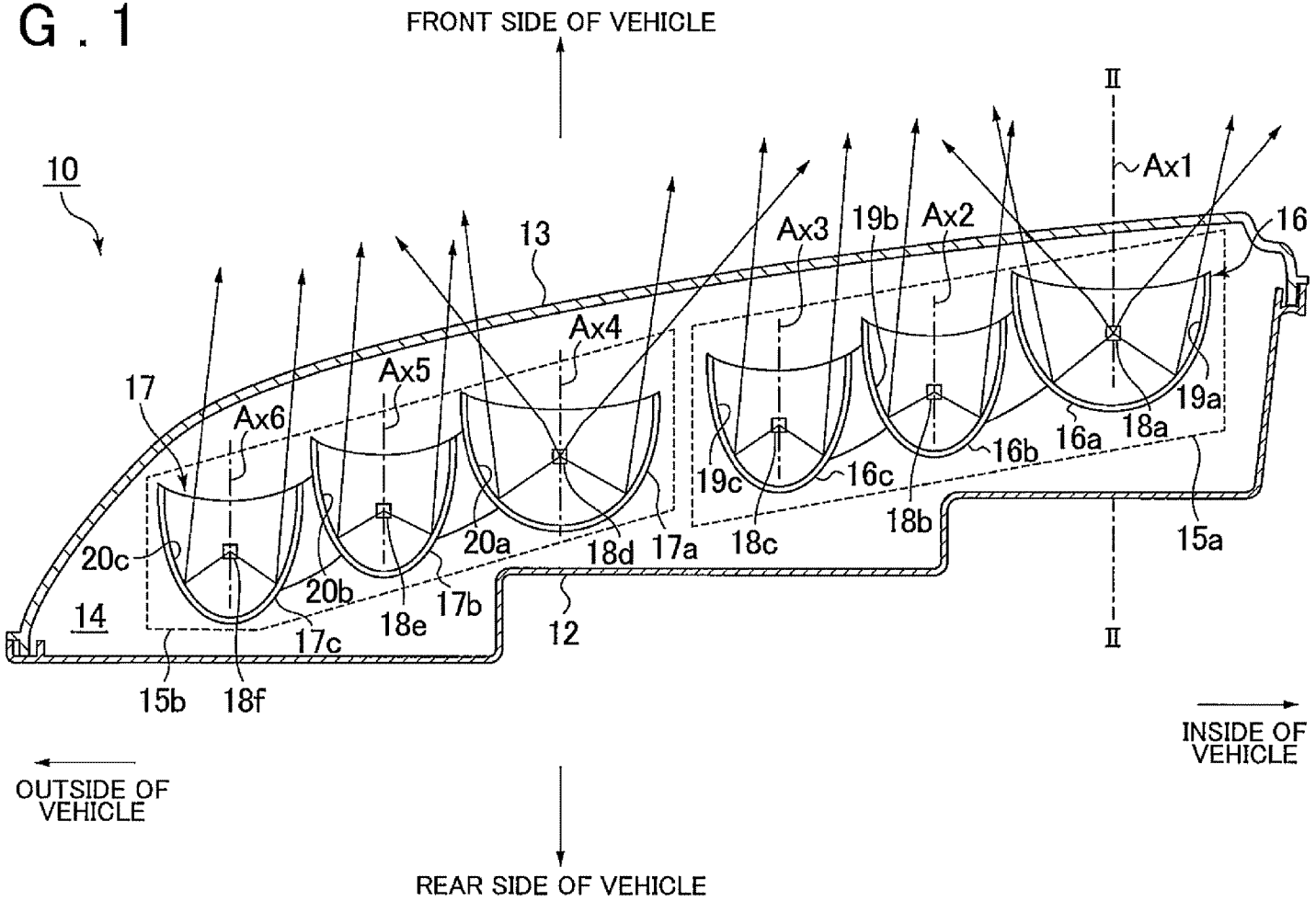
FIG. 1 is a schematic horizontal cross-sectional view of a vehicular lamp according to an embodiment of the invention.
Figure 2:
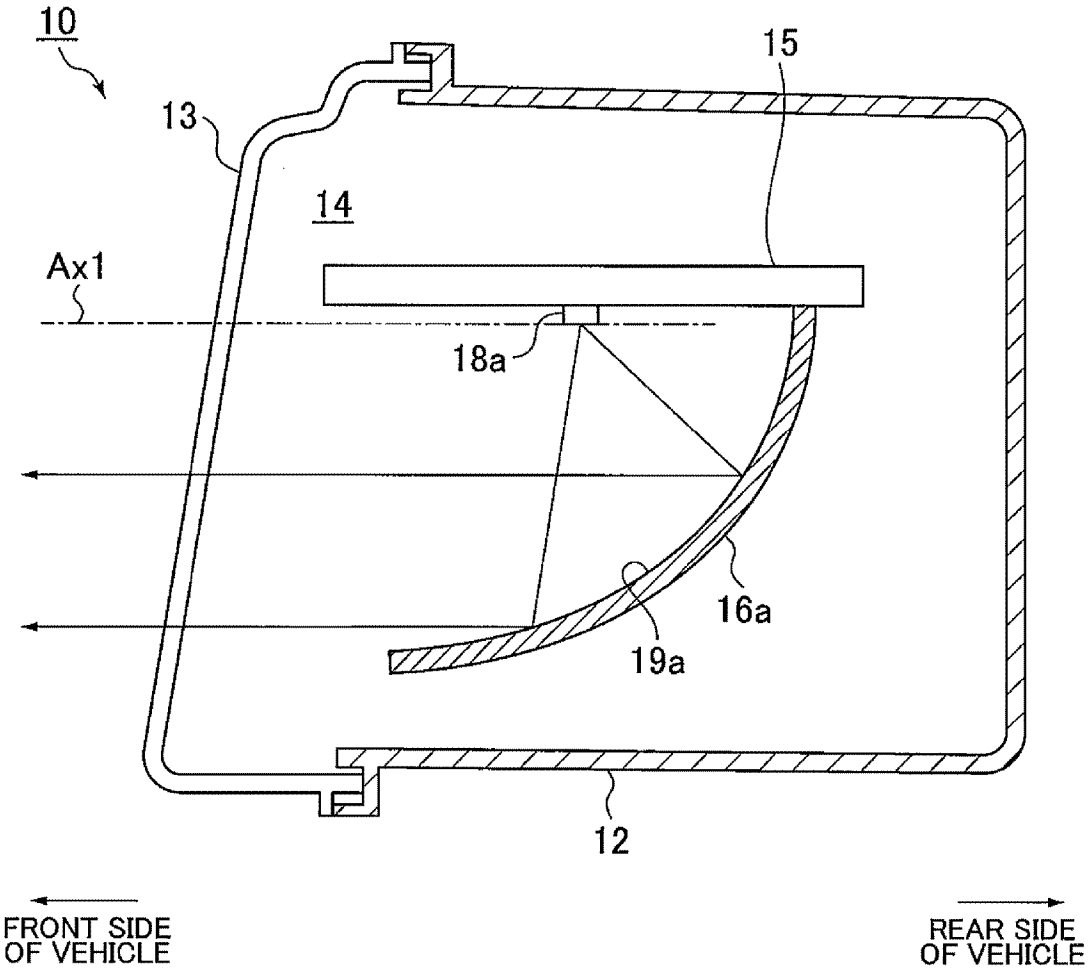
FIG. 2 is a cross-sectional view of the vehicular lamp taken along the line II-II in FIG. 1.

FIG. 1 is a schematic horizontal cross-sectional view of a vehicular lamp 10 according to the embodiment of the invention. In addition, FIG. 2 is a cross-sectional view of the vehicular lamp 10 taken along the line II-II in FIG. 1. Since the vehicular lamp 10 shown in FIG. 1 is a headlamp individually arranged on right and left sides at the front of the vehicle and its structure is substantially the same on the right and left sides, a description will be given of the structure of the vehicular lamp arranged on the left side of the vehicle as a representative vehicular lamp.

As shown in FIGS. 1 and 2, the vehicular lamp 10 includes a lamp body 12 and a transparent outer cover 13 that covers the front opening of the lamp body 12. The lamp body 12 and the outer cover 13 form a lamp chamber 14. As shown in FIG. 1, the outer cover 13 is formed in a shape along the slant nose shape of the vehicle and slanted rearwardly in a direction from the inside to the outside of the vehicle. The lamp body 12 is formed in a stepped shape being slanted rearwardly in the direction from the inside to the outside of the vehicle according to the shape of the slanted outer cover 13. Accordingly, the lamp chamber 14 formed by the lamp body 12 and the outer cover 13 is space slanted rearwardly in the direction from the inside to the outside of the vehicle.

The lamp chamber 14 accommodates a high beam circuit board 15*a*, a low beam circuit board 15*b*, a high beam reflector unit 16, and a low beam reflector unit 17.

The high beam circuit board 15*a* and the low beam circuit board 15*b* are arranged side by side at an upper level inside the lamp chamber 14. The high beam circuit board 15*a* is arranged on the inner side of the vehicle, and the low beam circuit board 15*b* is arranged on the outer side thereof. As shown in FIG. 1, each of the high beam circuit board 15*a* and the low beam circuit board 15*b* is formed in a shape slanted rearwardly in the direction from the inside to the outside of the vehicle according to the shape of the slanted outer cover 13.

Three LEDs (a first LED 18*a* to a third LED 18*c*) are mounted on the high beam circuit board 15*a* such that the light-emitting surfaces of the LEDs are directed downward. Each of the first LED 18*a* to the third LED 18*c* emits light upon receiving current from the high beam circuit board 15*a*. The first LED 18*a* to the third LED 18*c* are LEDs used to radiate a high beam and provided along the vehicle-width direction of the high beam circuit board 15*a*. Among the three LEDs, the first LED 18*a* is provided on the innermost side of the vehicle. The second LED 18*b* is provided on the outside of the first LED 18*a*, and the third LED 18*c* is provided on the outside of the second LED 18*b*.

Three LEDs (a fourth LED 18*d* to a sixth LED 18*f*) are mounted on the low beam circuit board 15*b* such that the light-emitting surfaces of the LEDs are directed downward. Each of the fourth LED 18*d* to the sixth LED 18*f* emits light upon receiving current from the low beam circuit board 15*b*. The fourth LED 18*d* to the sixth LED 18*f* are LEDs used to radiate a low beam and provided along the vehicle-width direction of the low beam circuit board 15*b*. Among the three LEDs, the fourth LED 18*d* is provided on the innermost side of the vehicle. The fifth LED 18*e* is provided on the outside of the fourth LED 18*d*, and the sixth LED 18*f* is provided on the outside of the fifth LED 18*e*.

The high beam reflector unit 16 and the low beam reflector unit 17 are arranged side by side beneath the high beam circuit board 15*a* and the low beam circuit board 15*b* inside the lamp chamber 14, respectively. The high beam reflector unit 16 is arranged on the inner side of the vehicle, and the low beam reflector unit 17 is arranged on the outer side thereof.

The high beam reflector unit 16 is a group of reflectors used to radiate a high beam and constituted of three parabolic reflectors, i.e., a high beam diffusion reflector 16*a*, a first high beam condensing reflector 16*b*, and a second high beam condensing reflector 16*c*. The three reflectors are integrally formed. Among the three reflectors, the high beam diffusion reflector 16*a* is provided on the innermost side of the vehicle. The first high beam condensing reflector 16*b* is provided on the outside of the high beam diffusion reflector 16*a*, and the second high beam condensing reflector 16*c* is provided on the outside of the first high beam condensing reflector 16*b*.

The high beam diffusion reflector 16*a*, the first high beam condensing reflector 16*b*, and the second high beam condensing reflector 16*c*, respectively, have reflection surfaces 19*a* to 19*c* formed based on the paraboloid of revolution. The revolution central axis of each paraboloid of revolution is coincident with the light axis of each of the reflectors. That is, the high beam diffusion reflector 16*a* has a first light axis Ax1, the first high beam condensing reflector 16*b* has a second light axis Ax2, and the second high beam condensing reflector 16*c* has a third light axis Ax3. The high beam diffusion reflector 16*a*, the first high beam condensing reflector 16*b*, and the second high beam condensing reflector 16*c* are arranged such that the first light axis Ax1, the second light axis Ax2, and the third light axis Ax3 are directed in the front-rear direction (horizontal direction) of the vehicle.

At the focal position (on the first light axis Ax1) of the reflection surface 19*a* of the high beam diffusion reflector 16*a*, the first LED 18*a* is arranged (see FIG. 2). At the focal position (on the second light axis Ax1) of the reflection surface 19*b* of the first high beam condensing reflector 16*b*, the second LED 18*b* is arranged. At the focal position (on the third light axis Ax3) of the second high beam condensing reflector 16*c*, the third LED 18*c* is arranged. Each of the reflectors reflects light from each of the LEDs in a direction parallel to the corresponding light axis.

The low beam reflector unit 17 is a group of reflectors used to radiate a low beam and constituted of three parabolic reflectors, i.e., a low beam diffusion reflector 17*a*, a first low beam condensing reflector 17*b*, and a second low beam condensing reflector 17*c*. The three reflectors are integrally formed. Among the three reflectors, the low beam diffusion reflector 17*a* is provided on the innermost side of the vehicle. The first low beam condensing reflector 17*b* is provided on the outside of the low beam diffusion reflector 17*a*, and the second low beam condensing reflector 17*c* is provided on the outside of the first low beam condensing reflector 17*b*.

The low beam diffusion reflector 17*a*, the first low beam condensing reflector 17*b*, and the second low beam condensing reflector 17*c* have reflection surfaces 20*a* to 20*c*, respectively, formed based on the paraboloid of revolution. The revolution central axis of each paraboloid of revolution is coincident with the light axis of each of the reflectors. That is, the low beam diffusion reflector 17*a* has a fourth light axis Ax4, the first low beam condensing reflector 17*b* has a fifth light axis Ax5, and the second low beam condensing reflector 17*c* has a sixth light axis Ax6. The low beam diffusion reflector 17*a*, the first low beam condensing reflector 17*b*, and the second low beam condensing reflector 17*c* are arranged such that the fourth light axis Ax4, the fifth light axis Ax5, and the sixth light axis Ax6 are directed in the front-rear direction (horizontal direction) of the vehicle.

At the focal position (on the fourth light axis Ax4) of the reflection surface 20*a* of the low beam diffusion reflector 17*a*, the fourth LED 18*d* is arranged. At the focal position (on the fifth light axis Ax5) of the reflection surface 20*b* of the first low beam condensing reflector 17*b*, the fifth LED 18*e* is arranged. At the focal position (on the sixth light axis Ax6) of the second low beam condensing reflector 17*c*, the sixth LED 18*f* is arranged. Each of the reflectors reflects light from each of the LEDs in a direction parallel to the corresponding light axis.

Each of the high beam reflector unit 16 and the low beam reflector unit 17 is formed in such a way that aluminum is deposited on the inside surface of a resin-molded base member.

Figure 3:
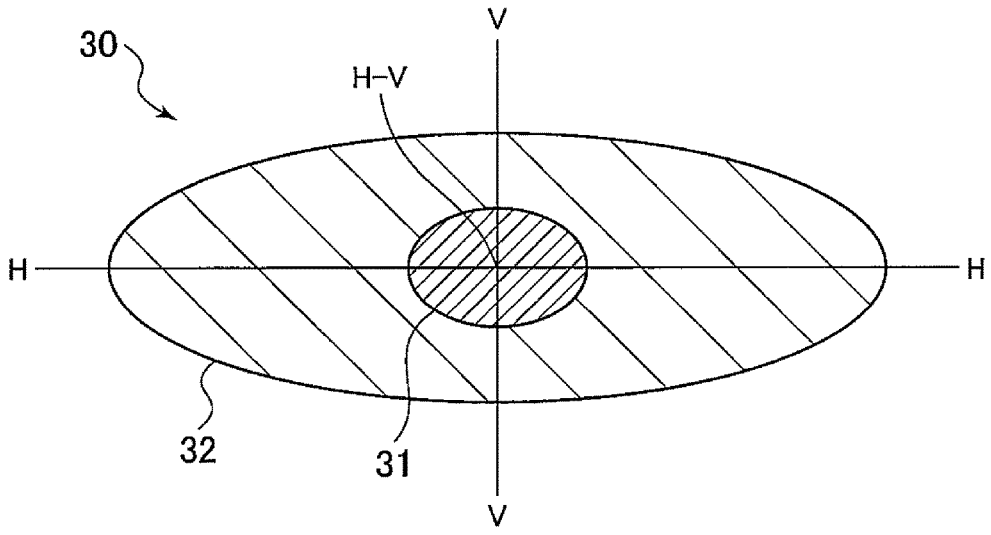
FIG. 3 is a view showing a high beam light distribution pattern formed by a high beam headlamp unit.

In the embodiment, the high beam reflector unit 16 and the first LED 18*a* to the third LED 18*c* constitute a high beam headlamp unit that radiates a high beam. FIG. 3 shows a high beam light distribution pattern 30 formed by the high beam headlamp unit. The high beam light distribution pattern 30 shown in FIG. 3 is a light distribution pattern formed on an imaginary vertical screen arranged at a position 25 meters ahead of the vehicular lamp 10. FIG. 3 shows a vertical line V-V passing through an H-V point as a vanishing point in the font direction of the headlamp and a horizontal line H-H passing through the H-V point.

By light reflected at the reflection surface 19*b* of the first high beam condensing reflector 16*b* after being emitted from the second LED 18*b* and light reflected at the reflection surface 19*c* of the second high beam condensing reflector 16*c* after being emitted from the third LED 18*c*, a high beam condensing light distribution pattern 31 is formed on the periphery of the H-V point. The high beam condensing light distribution pattern 31 is a high light intensity region called a "hot zone." In addition, by light reflected at the reflection surface 19*a* of the high beam diffusion reflector 16*a* after being emitted from the first LED 18*a*, a high beam diffusion light distribution pattern 32 is formed so as to cover the high beam condensing light distribution pattern 31. The high beam diffusion light distribution pattern 32 is wider than the high beam condensing light distribution pattern 31 in both the direction of the horizontal line H-H and the direction of the vertical line V-V. The high beam condensing light distribution pattern 31 may be, for example, a region ranging in the direction of the horizontal line H-H by about ±10° to 15° and ranging in the direction of the vertical line V-V by about ±3° to 5°. The high beam diffusion light distribution pattern 32 may be, for example, a region ranging in the direction of the horizontal line H-H by about ±25° to 35° and ranging in the direction of the vertical line V-V by about ±8° to 10°. The high beam condensing light distribution pattern 31 and the high beam diffusion light distribution pattern 32 are superimposed on each other to form the high beam light distribution pattern 30.

Figure 4:
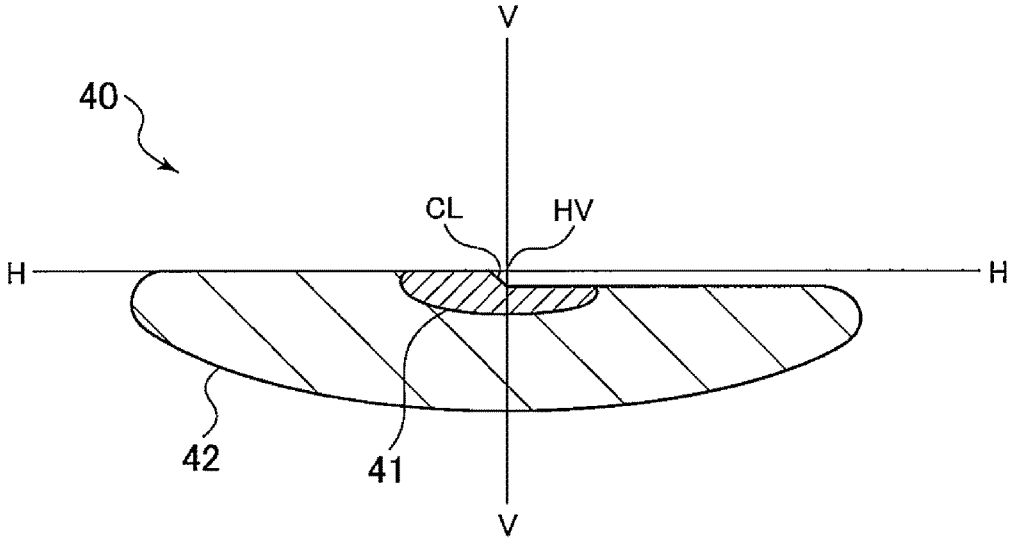
FIG. 4 is a view showing a low beam light distribution pattern formed by a low beam headlamp unit.

In addition, the low beam reflector unit 17 and the fourth LED 18*d* to the sixth LED 18*f* constitute a low beam headlamp unit that radiates a low beam. FIG. 4 shows a low beam light distribution pattern 40 formed by the low beam headlamp unit. The low beam light distribution pattern is a light distribution pattern having a cut-off line in a prescribed shape.

By light reflected at the reflection surface 20*b* of the first low beam condensing reflector 17*b* after being emitted from the fifth LED 18*e* and light reflected at the reflection surface 20*c* of the second low beam condensing reflector 17*c* after being emitted from the sixth LED 18*f*, a low beam condensing light distribution pattern 41 is formed on the periphery of the H-V point. The low beam condensing light distribution pattern 41 is a high light intensity region called a "hot zone" and has a cut-off line CL in a prescribed shape. In addition, by light reflected at the reflection surface 20*a* of the low beam diffusion reflector 17*a* after being emitted from the fourth LED 18*d*, a low beam diffusion light distribution pattern 42 is formed so as to cover the low beam condensing light distribution pattern 41. The low beam diffusion light distribution pattern 42 is wider than the low beam condensing light distribution pattern 41 in both the direction of the horizontal line H-H and the direction of the vertical line V-V. The low beam condensing light distribution pattern 41 may be, for example, a region ranging in the direction of the horizontal line H-H by about ±10° to 15° and ranging in the direction of the vertical line V-V by about 0° to −5°. The low beam diffusion light distribution pattern 42 may be, for example, a region ranging in the direction of the horizontal line H-H by about ±25° to 45° and ranging in the direction of the vertical line V-V by about 0° to −10°. The low beam condensing light distribution pattern 41 and the low beam diffusion light distribution pattern 42 are superimposed on each other to form the low beam light distribution pattern 40.

Figure 5:
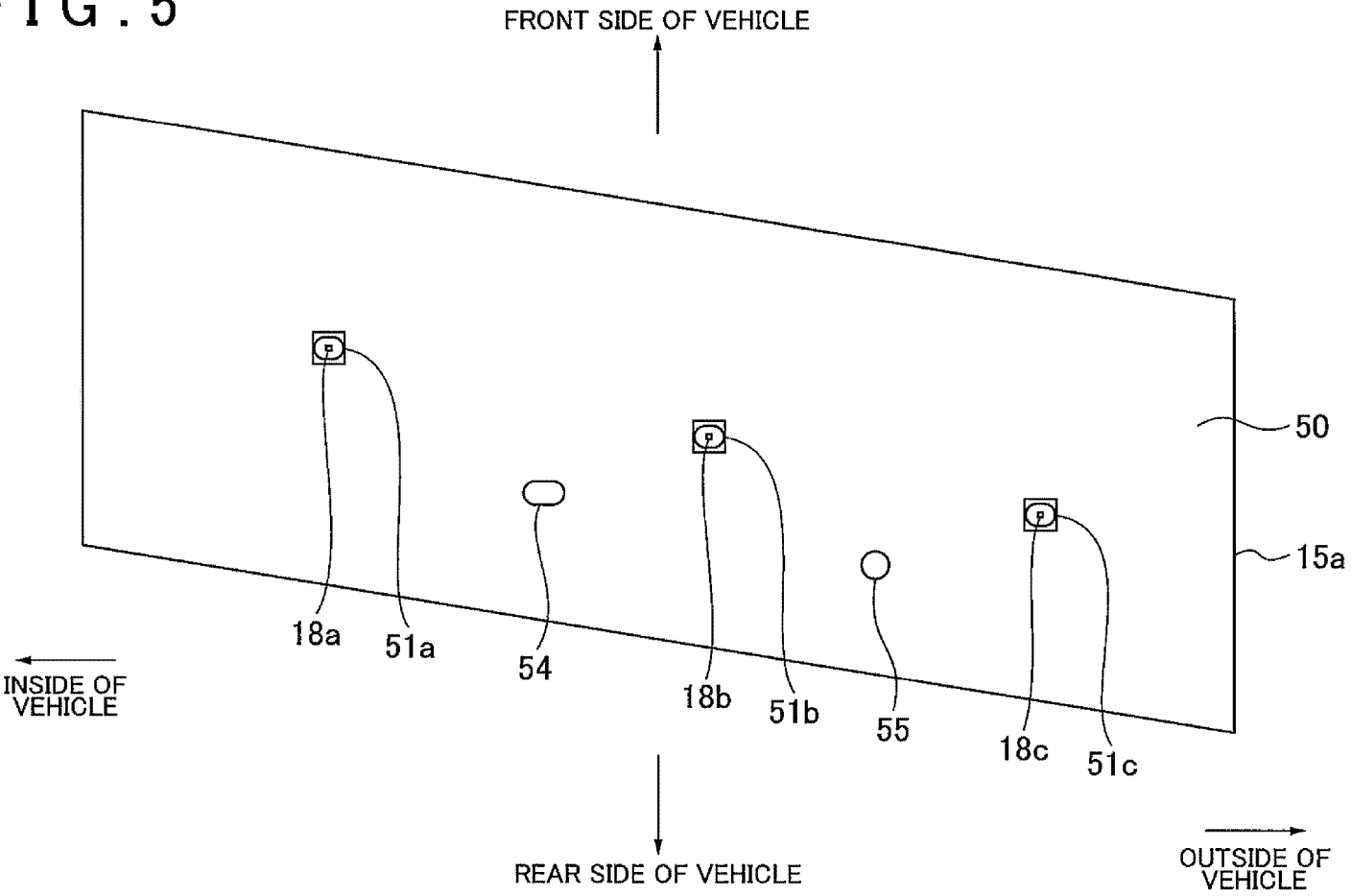
FIG. 5 is a view showing the parts mounting surface of a high beam circuit board.
Figure 6:
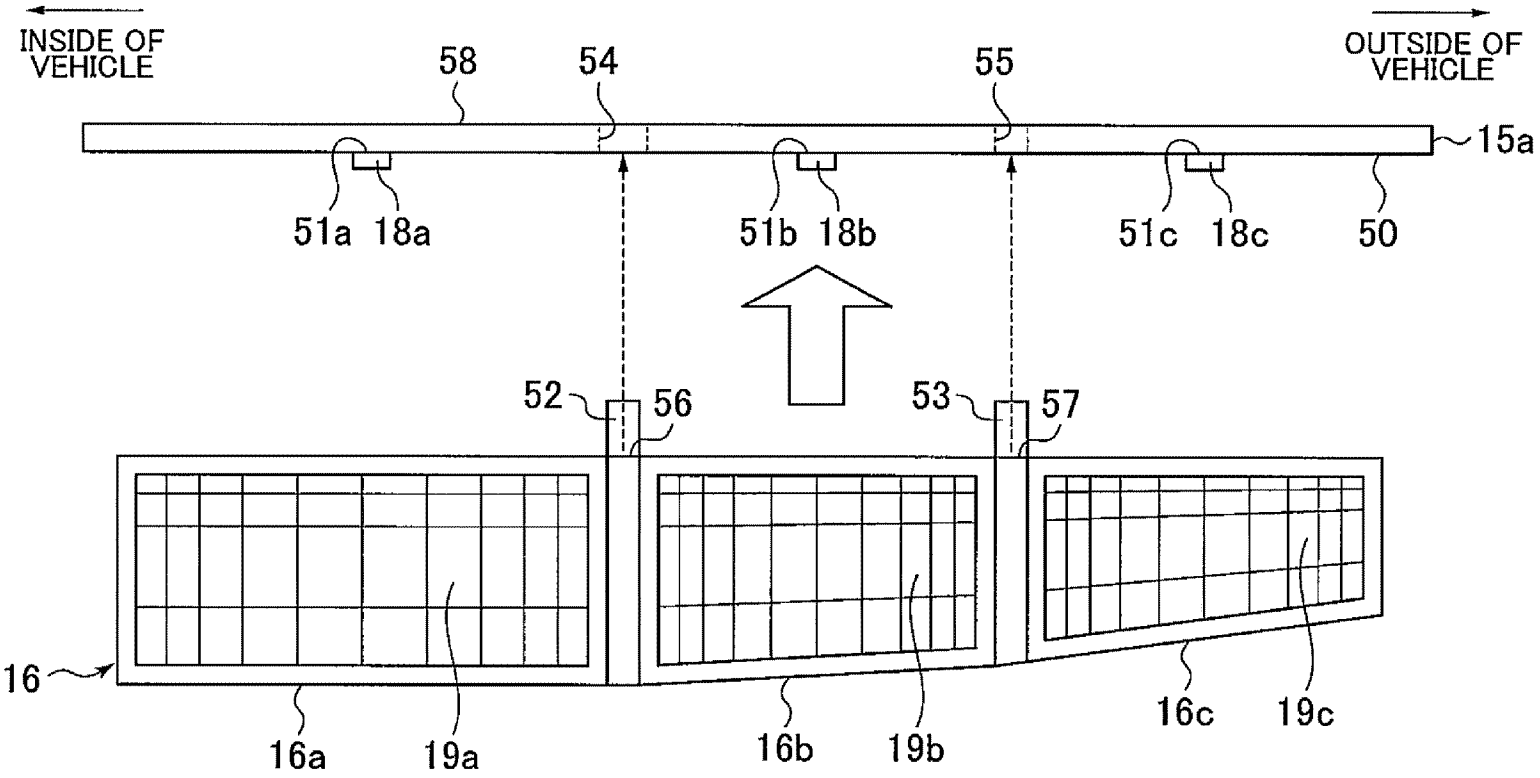
FIG. 6 is a view for describing the structure of assembling the high beam circuit board and a high beam reflector unit together.

FIG. 5 is a view showing a parts mounting surface 50 of the high beam circuit board 15*a*. FIG. 6 is a view for describing the structure of assembling the high beam circuit board 15*a* and the high beam reflector unit 16 together. The parts mounting surface 50 shown in FIG. 5 is directed downward at the time of being mounted on the vehicle. FIG. 6 shows a state in which the high beam circuit board 15*a* and the high beam reflector unit 16 are viewed from the front side of the vehicle.

The high beam circuit board 15*a* has, on the parts mounting surface 50 thereof, a first LED mounting portion 51*a*, a second LED mounting portion 51*b*, and a third LED mounting portion 51*c* for mounting the first LED 18*a*, the second LED 18*b*, and the third LED 18*c*, respectively, along the vehicle-width direction of the circuit board. Each of the LED mounting portions may be an electrode land for soldering the electrode of each of the LEDs. The high beam circuit board 15*a* has a copper foil pattern (not shown) for supplying current to each of the electrode lands.

As shown in FIG. 6, the high beam reflector unit 16 is mounted on the parts mounting surface 50 of the high beam circuit board 15*a*. In the embodiment, the high beam reflector unit 16 has a first positioning pin 52 and a second positioning pin 53. In addition, the high beam circuit board 15*a* has a first positioning hole 54 which is provided at a position corresponding to the first positioning pin 52 to receive the first positioning pin 52 and has a second positioning hole 55 which is provided at a position corresponding to the second positioning pin 53 to receive the second positioning pin 53. When the positioning pins 52 and 53 are arranged in the positioning holes 54 and 55, respectively, the high beam reflector unit 16 is positioned on the parts mounting surface 50 of the high beam circuit board 15*a*.

The first positioning pin 52 protrudes from a first joining portion 56 that joins the high beam diffusion reflector 16*a* and the first high beam condensing reflector 16*b* together. The second positioning pin 53 protrudes from a second joining portion 57 that joins the first high beam condensing reflector 16*b* and the second high beam condensing reflector 16*c* together. Each of the first positioning pin 52 and the second positioning pin 53 may be a cylindrical pin. The first positioning pin 52 and the second positioning pin 53 may be the same in size. Each of the first positioning pin 52 and the second positioning pin 53 may be formed to have a height corresponding to the thickness of the high beam circuit board 15*a* or more.

As shown in FIG. 5 and FIG. 6, the first positioning hole 54 is provided in the circuit board at a location inward of the first LED mounting portion 51*a* positioned on one end side (the inner side of the vehicle) in the vehicle-width direction of the high beam circuit board 15*a*, and the second positioning hole 55 is provided in the circuit board at a location inward of the third LED mounting portion 51*c* positioned on the other end side (the outer side of the vehicle) in the vehicle-width direction thereof. More specifically, the first positioning hole 54 is provided between the first LED mounting portion 51*a* and the second LED mounting portion 51*b* adjacent to the first LED mounting portion 51*a*, and the second positioning hole 55 is provided between the third LED mounting portion 51*c* and the second LED mounting portion 51*b* adjacent to the third LED mounting portion 51*c*.

In the embodiment, the first positioning hole 54 is a long hole extending in the vehicle-width direction of the circuit board. In a case in which the first positioning pin 52 to be inserted in the first positioning hole 54 has a cylindrical shape, the first positioning hole 54 is a long hole having the inside diameter thereof greater than the diameter of the first positioning pin 52 in the vehicle-width direction and having the inside diameter thereof substantially the same in size as the diameter of the first positioning pin 52 in the front-rear direction of the vehicle in a cross section perpendicular to the height direction of the circuit board. On the other hand, in the cross section perpendicular to the height direction of the circuit board, the second positioning hole 55 is a hole having the substantially same shape and size as the second positioning pin 53 to be inserted in the second positioning hole 55. In a case in which the second positioning pin 53 has a cylindrical shape, the second positioning hole 55 is a cylindrical hole having the inside diameter thereof same as the diameter of the second positioning pin 53.

When the high beam reflector unit 16 is assembled into the high beam circuit board 15*a*, the first positioning pin 52 and the second positioning pin 53 of the high beam reflector unit 16 are inserted in the first positioning hole 54 and the second positioning hole 55 of the high beam circuit board 15*a*, respectively, as shown in FIG. 6. Then, portions of the first positioning pin 52 and the second positioning pin 53 protruding to the side of the back surface 58 opposing the parts mounting surface 50 are subjected to thermal caulking to fix the high beam reflector unit 16 to the high beam circuit board 15*a*. Note that in the embodiment, the first positioning pin 52 and the second positioning pin 53 serve to position and fix the high beam reflector unit 16 to the high beam circuit board 15*a*. However, it may also be possible to use the first positioning pin 52 and the second positioning pin 53 only to position the high beam reflector unit 16 and perform the fixation of the high beam reflector unit 16 to the high beam circuit board 15*a* using other members. For example, it may also be possible to form holes in the high beam circuit board 15*a* and the high beam reflector unit 16 for screw fixation and fix the high beam reflector unit 16 to the high beam circuit board 15*a* using screws.

As for a vehicular lamp using a plurality of LEDs and a plurality of reflectors as in the embodiment, it is likely that the headlamp is upsized with an increase in the size of a circuit board since the plurality of LEDs and the plurality of reflectors are arranged. Accordingly, in the embodiment, the first positioning hole 54 is provided in the circuit board at a location inward of the first LED mounting portion 51*a* positioned on one end side in the vehicle-width direction of the high beam circuit board 15*a*, and the second positioning hole 55 is provided in the circuit board at a location inward of the third LED mounting portion 51*c* positioned on the other end side in the vehicle-width direction thereof. Thus, compared with a case in which the first positioning hole is provided in the circuit board at a location outward of the first LED mounting portion of the circuit board and the second positioning hole is provided in the circuit board at location outward of the third LED mounting portion, the length of the circuit board in the vehicle-width direction may be made shorter. Therefore, the vehicular lamp that is small in size although it has the plurality of LEDs and the plurality of reflectors can be achieved.

In addition, in the above embodiment, the first positioning hole 54 is the long hole extending in the vehicle-width direction of the circuit board, while the second positioning hole 55 is the hole having the substantially same shape and size as the second positioning pin 53 to be inserted in the second positioning hole 55. Since the high beam reflector unit 16 is a resin-molded item, it has a greater size tolerance than the parts mounting surface 50. One of the two positioning holes formed in the long hole as in the embodiment allows the size tolerance of the high beam reflector unit 16.

Moreover, in the above embodiment, the second positioning hole 55 formed to be substantially the same in shape and size as the second positioning pin 53 is, as shown in FIG. 5 and FIG. 6, provided at a position closer to the second LED mounting portion 51*b* and the third LED mounting portion 51*c* where the second LED 18*b* and the third LED 18*c* for condensing are mounted, respectively, than the first LED mounting portion 51*a* where the first LED 18*a* for diffusion is mounted. This is because the second LED 18*b* and the third LED 18*c* for condensing require higher positioning accuracy than the first LED 18*a* for diffusion. With such a configuration, the light distribution performance of the vehicular lamp 10 can be improved.

The above description is mainly applied to the structure of assembling the high beam circuit board 15*a* and the high beam reflector unit 16 together but may also be applied to the structure of assembling the low beam circuit board 15*b* and the low beam reflector unit 17 together.

The above embodiment describes that the three LEDs and the three reflectors are each provided in the high beam reflector unit 16 and the low beam reflector unit 17, but four or more LEDs and four or more reflectors may be each provided therein.

The invention is described above based on the embodiment. However, the embodiment is only for illustrative purposes, and various modifications to the combinations of the respective constituents and embodiments including such modifications are also within the scope of the invention.

The above embodiment describes the LEDs as light sources, but the light sources are not limited to the LEDs. For example, semiconductor lasers, bulbs, or the like may be used as such.

What is claimed is:

1. A vehicular lamp comprising:

a circuit board comprising a substrate and a circuit pattern printed on the substrate, the substrate having three or more light source mounting portions provided along a vehicle-width direction;

a plurality of light sources mounted directly on the respective light source mounting portions; and a reflector unit having three or more reflectors each reflecting light from each of the light sources, wherein:

the reflector unit is integrally formed with a first positioning pin and a second positioning pin;

the substrate has a first positioning hole to receive the first positioning pin and a second positioning hole to receive the second positioning pin;

the first positioning hole is provided at a location inward of a first end light source mounting portion in the vehicle-width direction, the first end light source mounting portion positioned on one end side of the circuit board in the vehicle-width direction, among the light source mounting portions; and the second positioning hole is provided at a position inward of a second end light source mounting portion in the vehicle-width direction, the second end light source mounting portion positioned on the other end side of the circuit board in the vehicle-width direction, among the light source mounting portion.

2. The vehicular lamp according to claim 1, wherein:

the first positioning hole is provided between the first end light source mounting portion and one of the light source mounting portions adjacent to the first end light source mounting portion; and the second positioning hole is provided between the second end light source mounting portion and one of the light source mounting portions adjacent to the second light source mounting portion.

3. The vehicular lamp according to claim 1, wherein:

the first positioning hole is a long hole extending in the vehicle-width direction of the substrate; and the second positioning hole has a substantially same shape and size as the second positioning pin.

4. The vehicular lamp according to claim 1, wherein:

the second positioning pin and the second positioning hole have a cylindrical shape, wherein an inside diameter of the second positioning hole is equal to a diameter of the second positioning pin.

* * * * *